US008926458B1

(12) United States Patent
Wood

(10) Patent No.: US 8,926,458 B1
(45) Date of Patent: Jan. 6, 2015

(54) FOOTBALL TRAINING AID

(71) Applicant: Cody J. Wood, Denver, CO (US)

(72) Inventor: Cody J. Wood, Denver, CO (US)

( * ) Notice: Subject to any disclaimer, the term of this patent is extended or adjusted under 35 U.S.C. 154(b) by 0 days.

(21) Appl. No.: 14/148,444

(22) Filed: Jan. 6, 2014

(51) Int. Cl.
*A63B 43/04* (2006.01)
*A63B 69/00* (2006.01)
*A63B 43/00* (2006.01)

(52) U.S. Cl.
CPC ..... *A63B 43/002* (2013.01); *A63B 69/00* (2013.01)
USPC ..... 473/595; 473/594; 473/570

(58) Field of Classification Search
USPC ..... 473/570, 594, 595, 603, 422, 438; 446/431
See application file for complete search history.

(56) References Cited

U.S. PATENT DOCUMENTS

| | | | | | |
|---|---|---|---|---|---|
| 2,524,546 | A * | 10/1950 | Sinclaire | 473/570 |
| 3,500,579 | A * | 3/1970 | Bryer | 446/437 |
| 5,000,451 | A | 3/1991 | MacDonald et al. | |
| 5,041,051 | A * | 8/1991 | Sonesson | 446/437 |
| 5,261,661 | A | 11/1993 | Lemmon | |
| 5,297,981 | A * | 3/1994 | Maxim et al. | 446/437 |
| 5,316,293 | A * | 5/1994 | Hamilton | 473/570 |
| 6,251,035 | B1 * | 6/2001 | Fa | 473/570 |
| 8,128,523 | B2 | 3/2012 | Laliberty et al. | |
| 8,512,177 | B2 * | 8/2013 | Krysiak et al. | 473/570 |
| 2012/0302128 | A1 * | 11/2012 | McClintock et al. | 446/431 |

* cited by examiner

*Primary Examiner* — Steven Wong
(74) *Attorney, Agent, or Firm* — Crossley Patent Law

(57) ABSTRACT

A football training aid for football practice with an external battery powered activation and a variable speed setting control mechanism in communication with an internal cam driven assembly configured to create a dynamic inertia and a shaking motion of the football when activated, thereby making the football more difficult to catch. Power speed settings range from slow to fast to accommodate the skill and age of the player and increase player grip strength to enhance performance during practice to simulate the movement of a football in game situations.

5 Claims, 3 Drawing Sheets

FOOTBALL TRAINING AID

BACKGROUND OF THE INVENTION

Various types of football training aids are known in the prior art. However, what is needed is a football training aid including a football body with a dynamic weight providing an innovative way for players to improve gripping and handling to help a player to handle and hold a football more securely with increased confidence. During a football game, a football player must be prepared to receive and successfully hold onto a football traveling at varying distances, speeds and with varying spins during a football game. During a routine football practice, a football undergoes various changes in motion due to varying speeds, angles, and directions from which the football must be thrown. The complexity of forces that affect the dynamic motion of a football when it is received during a live game is difficult to emulate during a practice session with a standard football. A missed catch by a receiver during a live game may make the difference between a win and a loss for his team. To cover the greatest variety of possible movements, the training aid must simulate the dynamic movement required to adequately prepare a player for the multiple scenarios typically encountered in successfully catching and grasping a football traveling at varying speeds and directions, along with varying spins during a football game. What is needed is a device which provides for activation during football practice to employ a level of dynamic inertia or shaking to make the football difficult to grasp and hold and that can be manufactured in a variety of sizes to accommodate youth, scholastic, and professional players.

The ideal device should provide for improvement of gripping strength and muscle memory in the hands to prevent fumbles, botched snaps, and other missed plays. The ideal device should further provide for added movement that forces a player to concentrate more intently on holding and handling the football securely so that when switching back to a conventional ball on game day, players will find the football easier to grasp and handle. The present device accomplishes these goals. The present device provides a combination of features not heretofore provided in football training aids.

FIELD OF THE INVENTION

The present invention relates to football training aid, and more particularly, to a football training aid which features an internal mechanism designed to create dynamic inertia or a shaking motion that can be activated during practice.

SUMMARY OF THE INVENTION

The general purpose of the present football training aid, described subsequently in greater detail, is to provide a football training aid which has many novel features that result in a football training aid which is not anticipated, rendered obvious, suggested, or even implied by prior art, either alone or in combination thereof.

To accomplish this, the present football training aid helps a player to handle or hold a football more securely with increased confidence, improve gripping strength and muscle memory in the hands, and to prevent fumbles, botched snaps, and other missed plays. Many of the prior art references rely upon various weighted materials disposed in a ball or a football to either stabilize a football in flight to enhance a spiral rotation thereof, to increase the weight of the football to enhance the catching thereof, or to impart an unpredictable bounce to the ball. However, no prior art reference has been discovered that relies upon an internal mechanism including a cam shaft within the football to provide a dynamic inertia and shaking motion of the football.

The present football training aid is a modified football which is battery powered and features an internal mechanism designed to create dynamic inertia or a shaking motion when activated and features multiple speed settings ranging from slow to fast. The football training aid provides for activation during practice to employ a level of dynamic inertia and shaking to make the ball difficult to grasp and hold. The added movement forces a player to concentrate more intently on holding and handling the football securely. When switching back to a conventional ball on game day, players will find the football easier to grasp and handle.

The present device includes a football having an battery operated internal mechanism devised to create dynamic inertia and a shaking motion when activated. The device provides for speed settings ranging from slow to fast, enhances performance in game situations, and fulfills the need for an innovative new training aid for football players that can be used during practice and during various drills. The football training aid can be used during practice and during various drills to enhance performance in game situations. The football training aid is compact and lightweight and ideal for use by quarterbacks, centers, running backs, receivers, and other players. The football training aid provides for a variety of sizes to accommodate youth, scholastic, and professional players.

Thus has been broadly outlined the more important features of the present football training aid so that the detailed description thereof that follows may be better understood and in order that the present contribution to the art may be better appreciated. The present invention can be modified to include obround, circular, or bar shaped cams, and wherein the rotation of each cam is symmetrically oriented along the longitudinal midline axis of said training football.

BRIEF DESCRIPTION OF THE DRAWINGS

Figures

DETAILED DESCRIPTION OF THE DRAWINGS

Figure 1:
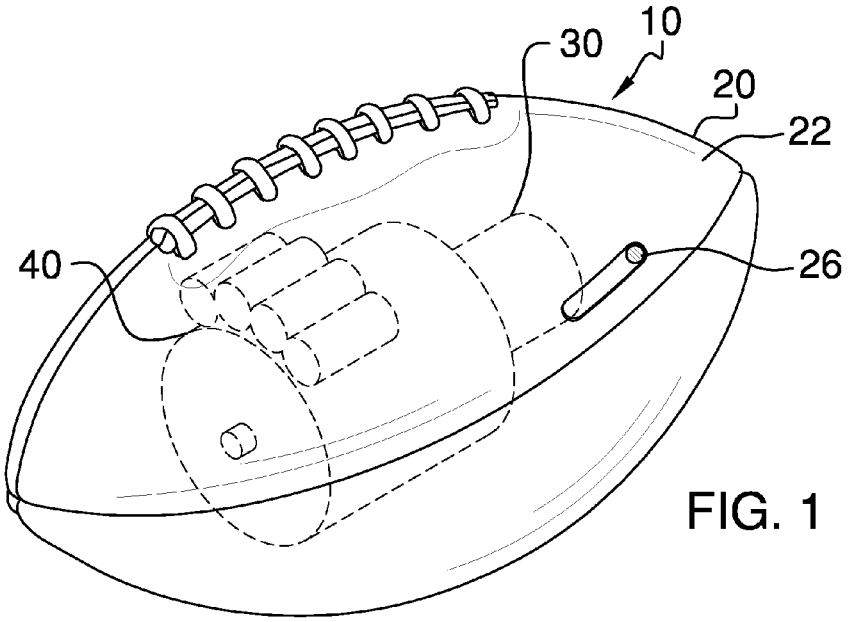
FIG. 1 is an isometric view of a football having an internal mechanism control.
Figure 2:
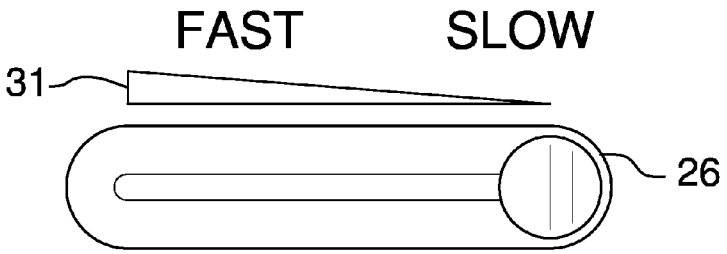
FIG. 2 is a view of an internal mechanism control.
Figure 3:
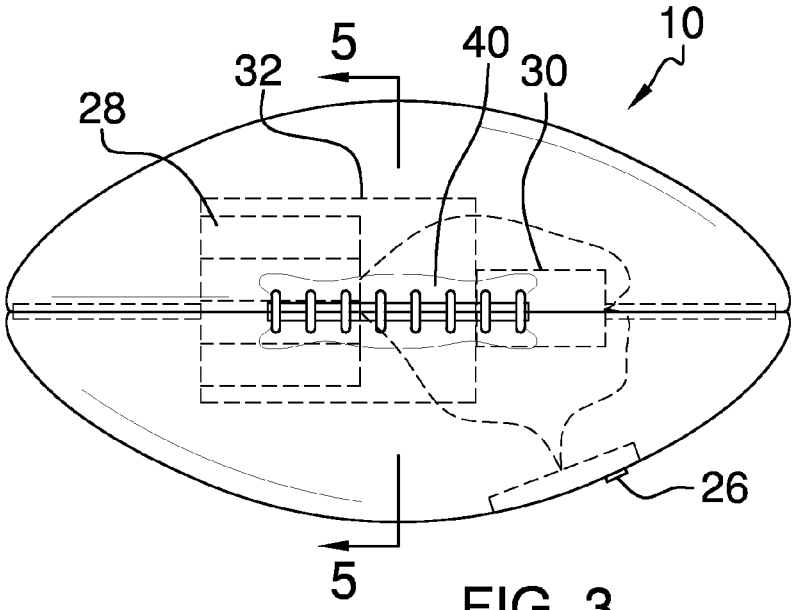
FIG. 3 is a top plan view.
Figure 4:
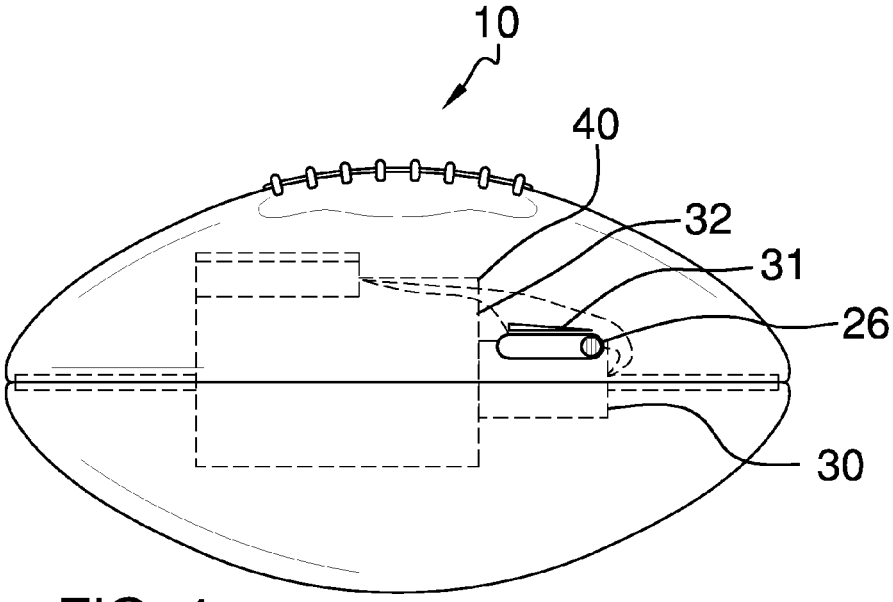
FIG. 4 is a side elevation view.
Figure 5:
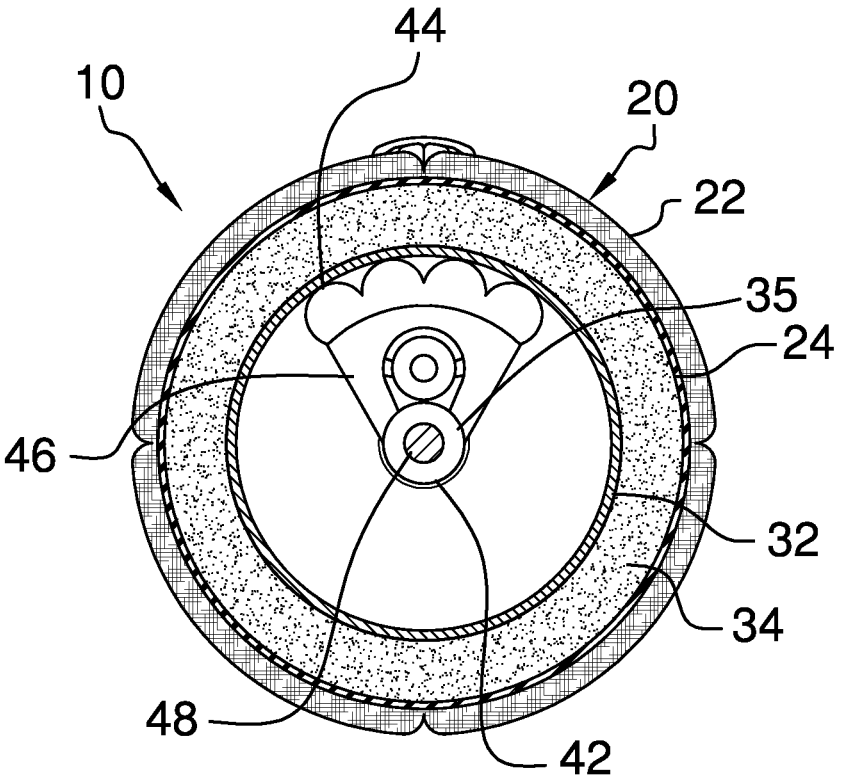
FIG. 5 is a cross-sectional view taken along line 5-5 of FIG. 3.

With reference now to the drawings, and in particular FIGS. 1 through 5 thereof, the football training aid employing the principles and concepts of the present football training aid and generally designated by the reference number 10 will be described.

Referring to FIGS. 1 through 5, the present football training aid 10 is illustrated. The present device 10 includes a football body 20 having a resilient outer cover 22 to provide a gripping surface. The outer cover 22 has an interior surface 24. A battery powered speed setting control mechanism 26 is disposed within the football body 20 and is accessible on the outer cover 22 for activation and adjustment of speed settings of an internal mechanism 30 disposed within the football body 20. The control mechanism 24 controls the activation and variable power speed settings of the internal mechanism 30 to activate and regulate the speed of a shaking motion of the football body 20. The power speed settings 31 have a range of speeds from a slow speed to a fast speed. A battery compartment 28 is disposed within the football body 20.

The football body 20 has a longitudinal midline axis and a vertical midline axis. A first chamber 32 is centrally disposed within the football body 20. An air-filled bladder 34 is continuously disposed between the internal surface 24 and the first chamber 32. The air bladder 34 is inflated to achieve turgidity and aerodynamic properties of the football body 20.

An internal mechanism 40 is centrally disposed within the first chamber 32. The internal mechanism 40 includes a cylinder 35 centrally disposed within the football body 20 along the longitudinal midline axis thereof. A shaft 42 is centrally disposed within the cylinder 35. A plurality of cams 44 in operational communication with the cylinder 35 is provided. Each cam 44 individually rotationally attaches to the shaft 42. Each cam 44 has a first end 46 and a second end 48 opposite the first end 46 with an offset pivot point 50 positioned between the first and second ends 46, 48. The offset pivot point 50 of each cam 44 is rotatingly connected to the shaft 42 along the longitudinal midline axis. Each cam 44 is spaced apart along the shaft 42 to distribute dynamic inertial forces along longitudinal midline axis. When the control mechanism 26 is activated, the rotation of the cams 44 around the shaft 42 creates a dynamic inertia to impart a shaking motion to the football body 20.

What is claimed is:

1. A football training aid devised to create a shaking motion for football practice, the football training aid comprising:

a football body having a longitudinal midline axis and a vertical midline axis, the football body having a resilient outer cover, the outer cover having an continuous interior surface;

a first chamber centrally disposed within the football body;

an air-filled bladder continuously disposed between the internal surface and the first chamber;

an internal mechanism centrally disposed within the first chamber, the internal mechanism comprising:

a cylinder centrally disposed within the football body along the longitudinal midline axis;

a shaft centrally disposed within the cylinder;

a plurality of cams in operational communication with the cylinder, each cam individually rotationally attached to the shaft, each cam comprising:

a first end and a second end opposite the first end;

an offset pivot point disposed between the first and second ends, the offset pivot point rotatingly connected to the cylinder along the longitudinal midline axis;

a battery-powered speed setting control mechanism disposed on the outer cover, the speed setting control mechanism in operational communication with the cylinder;

wherein upon activation of the control mechanism the cams are activated;

wherein upon activation of the cams, the cams rotate around the pivot point; and wherein the rotation of the cams around the pivot point is configured to impart a shaking motion to the football body.

2. The football training device of claim 1 further comprising:

a power speed setting of the control mechanism, the power speed setting having a range of speeds from a slow speed to a fast speed;

wherein activation of the control mechanism activates the cylinder in the power speed setting.

3. The football training aid of claim 2 wherein each cam is elongate.

4. The training football of claim 3 wherein the rotation of the cams is symmetrically oriented along the longitudinal midline axis of the football body.

5. The football training aid of claim 2 wherein each cam is obround.

* * * * *